US007260869B2

(12) United States Patent
Kim

(10) Patent No.: US 7,260,869 B2
(45) Date of Patent: Aug. 28, 2007

(54) ACCESSORY ASSEMBLY FOR VACUUM CLEANERS

(75) Inventor: Tak-soo Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 531 days.

(21) Appl. No.: 10/802,218

(22) Filed: Mar. 17, 2004

(65) Prior Publication Data

US 2005/0044660 A1 Mar. 3, 2005

(30) Foreign Application Priority Data

Aug. 27, 2003 (KR) ..... 10-2003-0059635

(51) Int. Cl.
*A47L 9/06* (2006.01)

(52) U.S. Cl. ..... 15/416; 15/398; 15/393

(58) Field of Classification Search ..... 15/415.1, 15/416, 393, 398, 400; *A47L 9/02, 9/06*
See application file for complete search history.

(56) References Cited

U.S. PATENT DOCUMENTS

| | | | | |
|---|---|---|---|---|
| 2,351,507 | A * | 6/1944 | Hallock | 15/415.1 |
| 2,842,793 | A * | 7/1958 | Hurd | 15/416 |
| 3,259,934 | A * | 7/1966 | Leinfelt | 15/416 |
| 4,897,894 | A * | 2/1990 | Fahlen | 15/416 |
| 5,652,997 | A * | 8/1997 | Na | 15/400 |
| 6,820,305 | B2 * | 11/2004 | Albert et al. | 15/415.1 |
| 2003/0140450 | A1 * | 7/2003 | Pineschi | 15/416 |
| 2004/0045127 | A1 | 3/2004 | Albert et al. | 15/415.1 |

FOREIGN PATENT DOCUMENTS

| | | |
|---|---|---|
| DE | 29610327 | 9/1996 |
| DE | 10108639 | 9/2002 |
| JP | S63-104845 | 8/1988 |
| JP | 64-035196 | 2/1989 |
| JP | 2000-051125 | 2/2000 |
| JP | 2000-229052 | 8/2000 |
| WO | WO 02-067748 | 9/2002 |

* cited by examiner

*Primary Examiner*—Theresa T. Snider
(74) *Attorney, Agent, or Firm*—Ladas & Parry LLP

(57) ABSTRACT

An accessory assembly for a vacuum cleaner comprises: an accessory body; a crevice attachment and an upholstery attachment, both formed integrally with the accessory body; and a dusting attachment disposed on the accessory body, the dusting attachment being slidably deployable to extend beyond the crevice attachment. Convenient cleaning can be achieved by selectively using the dusting attachment during the cleaning of a groove or narrow gap and deployment from one accessory attachment to another is easily accomplished without interruption of the cleaning process. The accessory assembly may be conveniently stored and used on an extension tube of the vacuum cleaner.

10 Claims, 4 Drawing Sheets

ACCESSORY ASSEMBLY FOR VACUUM CLEANERS

BACKGROUND OF THE INVENTION

1. Field of the Invention

The present invention relates generally to an accessory assembly for a vacuum cleaner, and more particularly to an accessory assembly that enables easy and convenient change from one accessory to another and providing easy storage of the accessory assembly.

2. Description of the Related Art

As shown in FIG. 1, a conventional vacuum cleaner comprises a body 10 provided with a vacuum-generating device (not separately shown), a handle tube 20 providing easy handling capability for a user, a flexible hose 15 connecting the handle tube 20 and the body 10, a suction brush 35 that is brought into contact with a surface to be cleaned and which draws in air in which dust and soil is entrained, and an extension tube 25 connected to the handle tube 20, to which the suction brush is detachably fitted on the extension tube 25.

In addition, conventional vacuum cleaners are provided with various accessories that can perform cleaning operations along a surface to be cleaned when accessories available for more specialized cleaning operations replace the suction brush 35 at the distal end of the extension tube 25. For example, when cleaning a corner or a groove in a surface, the user can effectively perform the cleaning operation by removing the suction brush 35 from the extension tube 25 and exchanging the suction brush 35 for another accessory, such as a crevice accessory 31 or brush bristles 33. Such accessories may be stored within the body 10. Alternatively, the user may store such a crevice accessory 31 or brush bristles 33 in an accessory receiving apparatus 30 disposed on the extension tube 25, as shown.

The accessory receiving apparatus 30 is formed with a plurality of engaging protrusions 34 in such a way that the accessories such as the brush bristles 33, the crevice accessory 31, and the like, are detachably engaged with the protrusions 34.

The conventional vacuum cleaner with the afore-mentioned construction operates in the following manner. At first, as electric power is applied to the vacuum cleaner, suction force is generated in the cleaner body 10, whereby air, in which dust and soil is entrained, is drawn in through the suction brush 35 from a surface to be cleaned. The air drawn into the vacuum cleaner in this manner is directed to the cleaner body 10 through the extension tube 25, the handle tube 20 and the flexible hose 15.

If the surface to be cleaned is positioned at a corner or cleaning of a narrow groove or gap is necessary, the user may remove the suction brush 35 from the extension tube 25 and replace it with any of the accessories, for example, brush bristles 33 and the crevice accessory 31 for more efficient cleaning. The accessory is removed from the accessory receiving apparatus 30, as needed, and is attached to the extension tube 25.

Then, the user can easily clean places that could not be easily cleaned by the suction brush 35, such as a groove, a recessed gap or a corner, by using the crevice accessory 31 or the brush bristles 33.

However, a conventional vacuum cleaner provided with the accessories as mentioned above has the following problems.

1) Respective accessories such as brush bristles 33, or crevice accessory 31, etc., are not integrally formed with one another, thus requiring separate storage locations on the suction tube 25 and thereby, the space required for storing them is increased.

2) When a user wishes to clean a groove or narrow gap by using a crevice accessory 31 during cleaning of a given space when using the brush bristles 33, operation of the vacuum cleaner must be interrupted to remove the brush bristles 33 from the extension tube 25, and then to fit the crevice accessory 31 onto the extension tube 25. Therefore, it is difficult and inconvenient to perform a continuous, uninterrupted cleaning operation.

3) Because the brush bristles 33 or the crevice accessory 31 are individually formed as separate components, the unit costs for production are increased. Therefore, the conventional arrangement is not economical.

SUMMARY OF THE INVENTION

Accordingly, the present invention has been proposed to solve the above-mentioned problems occurring in the prior art devices, and an aspect of the present invention is to provide an accessory assembly for a vacuum cleaner improved in constitution and capable of being conveniently used.

In order to achieve the above aspect, there is provided an accessory assembly for a vacuum cleaner comprising: an accessory body; a crevice attachment and an upholstery attachment, both of which are integrally formed with the accessory body; and a dusting attachment disposed on the accessory body, the dusting attachment being slidably deployable to extend beyond the crevice attachment.

The accessory body, the crevice attachment and the upholstery attachment may be integrally formed and be in fluid communication with one another, and the dusting attachment is mounted to wrap the outer surface of the accessory body and being slidably attached thereto.

In addition, the crevice attachment and the upholstery attachment may be integrally formed at opposite ends, respectively, of the accessory body, which has a diameter, and wherein the crevice attachment has a suction port smaller than the diameter of the accessory body, the upholstery attachment has a widened section larger than the diameter of the accessory body, and the dusting attachment further comprises brush bristles having ends.

At this time, the accessory body may be formed with a longitudinal rail slot for guiding the dusting attachment, and one side of an inner surface of the dusting attachment may be formed with a rail projection corresponding to the rail slot, wherein it is preferable that one end of the rail slot is formed with a first locking projection for retaining the rail projection, the other end of the longitudinal rail is formed with a circumferential rail slot to accommodate retention of the dusting attachment when it is turned to a predetermined angle and fixed, and a second locking projection is formed in the circumferential rail.

The brush bristles ends may extend beyond the suction port of the crevice attachment when the dusting attachment is engaged with the second locking projection, and the widened section of the upholstery attachment may be provided with a floor brush that contacts the surface to be cleaned.

Moreover, the suction port of the crevice attachment has an inclined opening relative to the longitudinal direction of the accessory body, and the brush bristles may be inclined in the same orientation as opening of the suction port of the crevice attachment, wherein the widened section of the upholstery attachment is formed to be symmetrically, but oppositely inclined relative to the incline orientation of the suction port of the crevice attachment with reference to the longitudinal direction of the accessory body.

BRIEF DESCRIPTION OF THE DRAWINGS

The above and other aspects, features and advantages of the present invention will be made more apparent from a complete understanding of the following detailed description taken with reference to the accompanying drawings, in which:

FIGS. 4A, 4B and 4C are side views showing respective configurations for operation of the accessory assembly according to the present invention, in which FIG. 4A shows the operation of the crevice attachment, FIG. 4B shows the operation of the dusting attachment and FIG. 4C shows the operation of the upholstery attachment.

DETAILED DESCRIPTION OF THE PREFERRED EMBODIMENTS

Hereinbelow, the embodiments of the present invention will be described in detail with reference to the accompanying drawings.

Figure 1:
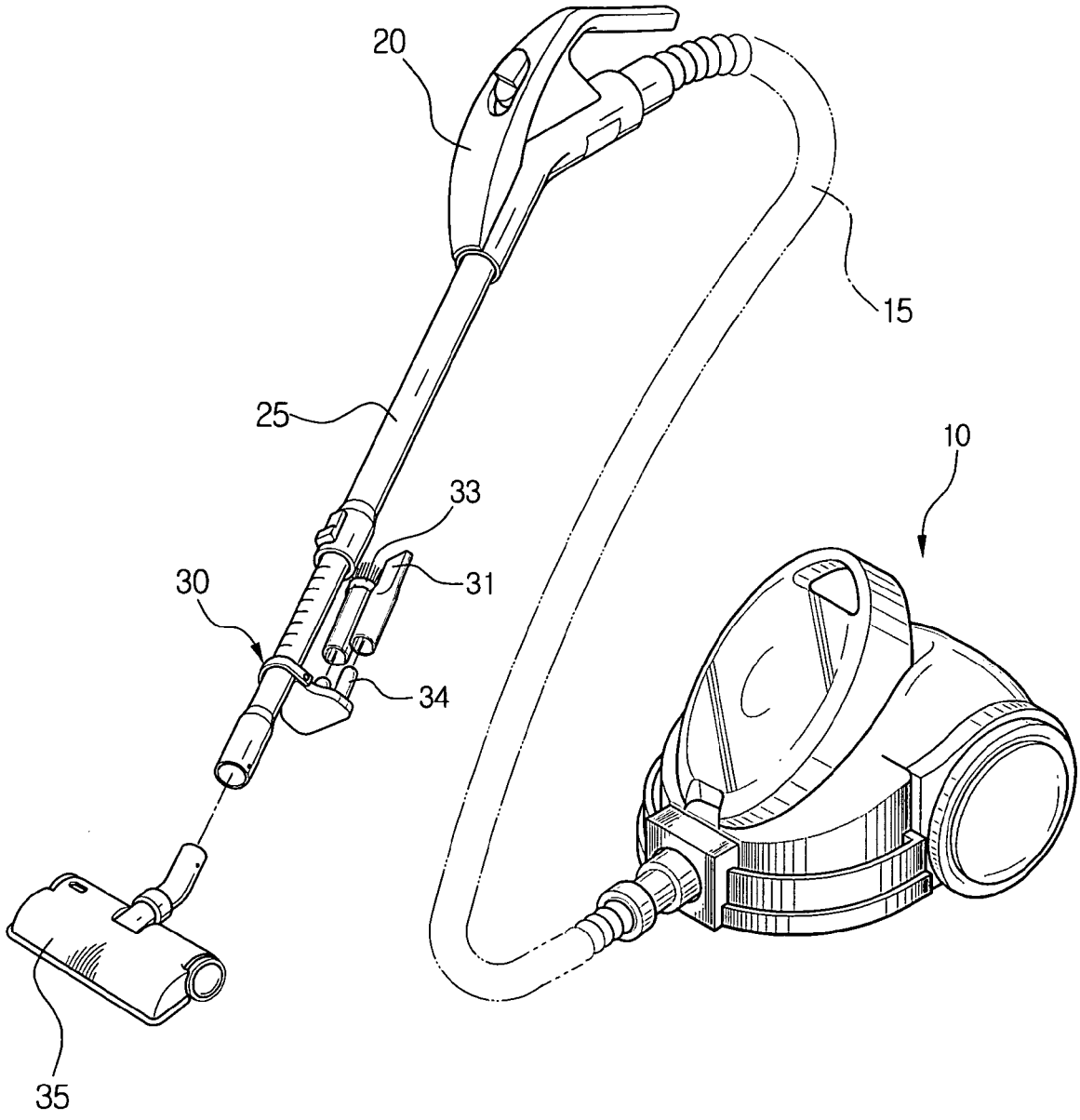
FIG. 1 (PRIOR ART)
FIG. 1 is a perspective view of a conventional vacuum cleaner.
Figure 2:
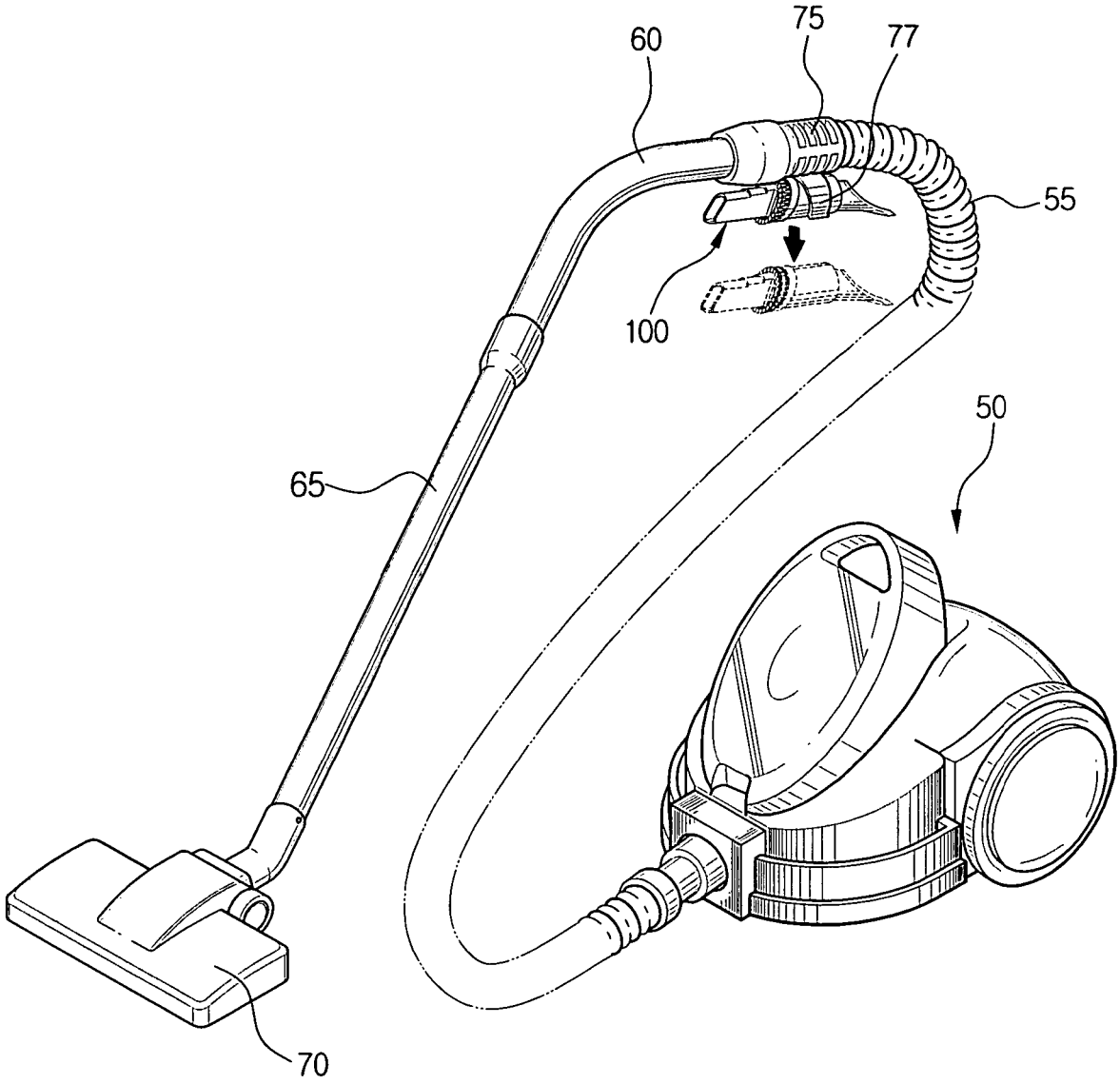
FIG. 2 is a perspective view of a vacuum cleaner provided with an accessory assembly according to the present invention.

FIG. 2 is a perspective view of a vacuum cleaner provided with an accessory assembly according to the present invention. The vacuum cleaner employing the accessory assembly according to the present invention comprises a body 50 equipped with a vacuum generation apparatus (not shown) for generating a suction force; a handle tube 60 arranged to be easily handled by a user; a flexible hose 55 connecting the handle tube 60 and the body 50; a suction brush 70 adapted to contact a surface to be cleaned for drawing in air in which is entrained dust and soil from the surface to be cleaned; and an extension tube 65, connected at one end to the handle tube 60, the suction brush 70 being detachably engaged at the other end of the to the extension tube 65.

In addition, a connection pipe 75 is installed between the handle tube 60 and the flexible hose 55 for connecting the two, a tension rib 77 is formed integrally with the connection pipe 75, and an accessory assembly 100, according to the present invention, is detachably engaged to the tension rib 77.

The extension tube 65 is detachably engaged with the handle tube 60. To clean a corner or a gap that is difficult to clean by use of the suction brush 70, the user removes the extension tube 65 from the handle tube 60. Then, the user may use the accessory assembly 100 by detaching it from the tension rib 77 and assembling it on the end of the handle tube 60.

Figure 3:
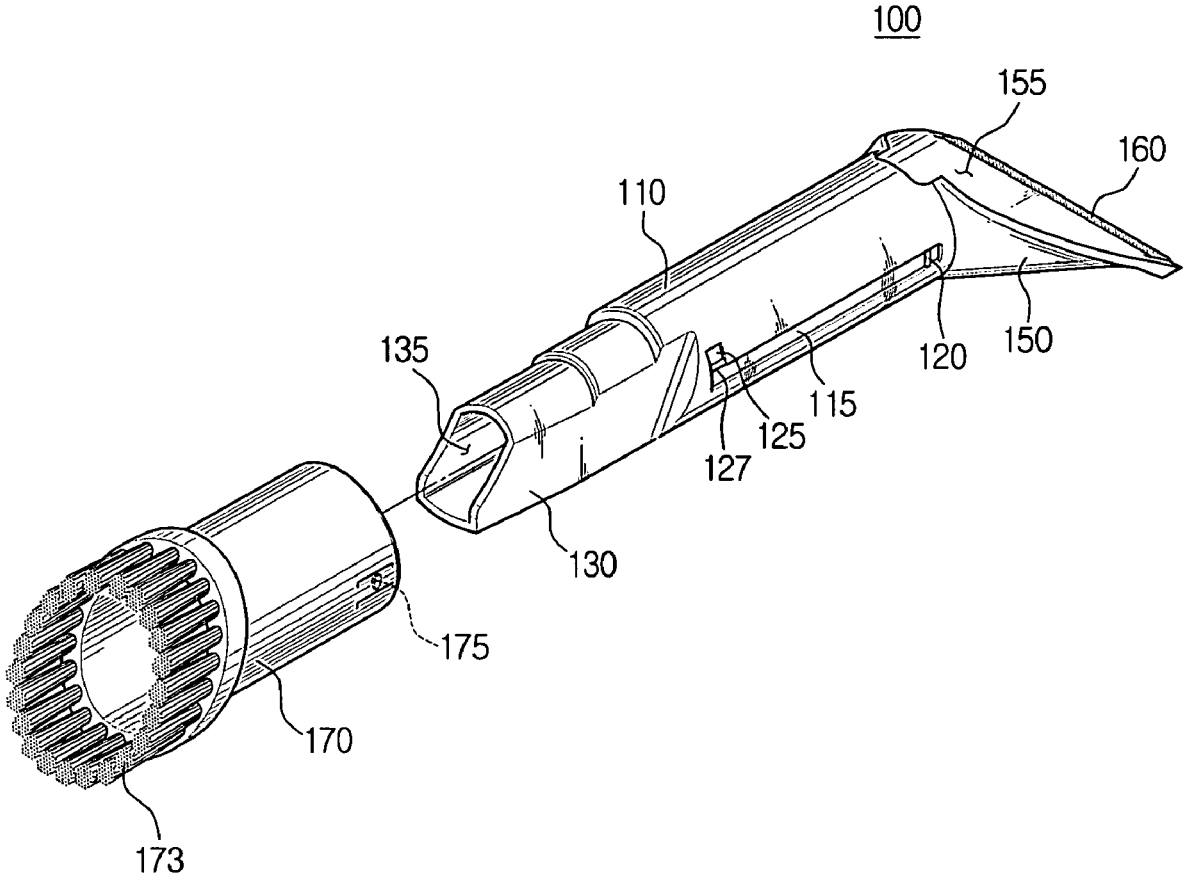
FIG. 3 is a partially exploded perspective view showing the accessory assembly according to a preferred embodiment of the present invention.

Hereinbelow, the accessory assembly 100 will be described in greater detail with reference to FIG. 3.

The accessory assembly 100 for a vacuum cleaner generally comprises an accessory body 110, a crevice attachment 130 and an upholstery attachment 150, which are preferably formed integrally with the accessory body 110, and a dusting attachment 170 displaceably engaged with crevice attachment 130 of the accessory body 110.

The accessory body 110, the crevice attachment 130 and the upholstery attachment 150 are integrally formed and can be in fluid communication with one another, and the crevice attachment 130 and the upholstery attachment 150 preferably are arranged at opposite ends of the accessory body 110, respectively.

The accessory body 110 may be formed substantially in the shape of a cylinder and a rail slot 115 is formed on the side of accessory body 110 to guide the dusting attachment 170. A rail projection 175, corresponding to the rail slot 115, is formed on an inside surface of the dusting attachment 170. Therefore, the dusting attachment 170 is slidably displaceable in a longitudinal direction along the rail slot 115 on the accessory body 110.

One longitudinal end of the rail slot 115 is formed having a first locking projection 120 for fixing the rail projection 175. In addition, the other longitudinal end of the rail slot 115 is formed having a circumferential rail 125 and a second locking projection 127 for allowing the dusting attachment 170 to be rotated by a predetermined angle and then to be fixed by engaging the second locking projection 127 in the circumferential rail 125.

The dusting attachment 170 is fitted over the accessory body 110 and is configured so as to wrap the outer surface of the accessory body 110. As shown, the dusting attachment is disposed between the crevice attachment 130 and the upholstery attachment 150 along the rail slot 115. The dusting attachment 170 corresponds to the shape of the accessory body; for example, it may also have a cylindrical shape.

In addition, the dusting attachment 170 includes brush bristles 173 that are equally spaced from each other and which are oriented in the direction of the crevice attachment 130. The brush bristles 173 allow easy cleaning of dust that may be found in difficult to reach locations, such as at a recessed window frame or corner.

If the dusting attachment 170 is engaged within the second locking projection 127, it is fixed on the accessory body in such a manner that the brush bristles 173 extend beyond a suction port 135 formed in the crevice attachment 130. Therefore, when the dusting attachment 170 is fixed to the second locking projection 127, the dusting attachment 170 is easily fixed so that it is projected forward beyond the crevice attachment (see FIG. 4B) and thus the dusting attachment 170 may be selectively used as desired when cleaning a recessed or difficult to reach location.

The crevice attachment 130 has the suction port 135 at an end of the accessory body 110, wherein the suction port 135 is fanned to have a size smaller than the diameter of the accessory body 110, thereby permitting the user to easily insert the end of accessory assembly 100 into a recessed corner, groove or gap to be cleaned. In addition, the suction port 135 may be formed having a rectangular cross-section, as shown in FIG. 3. It is also possible to form the suction port 135 in various alternative shapes, such as a cylindrical shape (not shown), as desired.

The upholstery attachment 150 comprises a widened section 155 at the other end of the accessory body 110 opposite to the crevice attachment 130, wherein the widened section 155 is formed to have a size larger than the diameter of the accessory body 110.

The widened section 155 is formed having a semi-circular cross-section. However, its shape may take various alternative shapes, and may have a triangular or rectangular cross-section (not shown), as desired. Furthermore, the widened section 155 may be provided with a floor brush 160 that comes into contact with a surface to be cleaned. Specifically, when woven materials, such as a sofa or curtain, are cleaned using the upholstery attachment 150, the upholstery attachment serves to apply frictional force for preventing easy sliding and to scrape out dust adhered to the woven materials. Therefore, because the upholstery attachment is provided with the widened section 155 and the floor brush 160 which are larger than the diameter of the accessory body 110, it is possible to more easily clean woven materials or the like.

The suction port 135 of the crevice attachment 130 has an inclined opening in relation to the longitudinal direction of accessory body 110. The brush bristles 173 of the dusting attachment are formed so that they are also inclined, preferably in the same direction and orientation as the opening of suction port 135 of the crevice attachment 130. Moreover, the suction port 135 of the crevice attachment 130 is symmetrically inclined, but oppositely oriented, relative to the inclined direction of the widened section 155 of the upholstery attachment 150, with reference to the longitudinal direction of the accessory body 110. Alternatively, the brush bristles 173, the crevice attachment 130 and the widened section 155 may be inclined in different orientations and directions predetermined by a manufacturer, as desired. The inclination of these elements allows easy cleaning of a recessed gap or the like that is difficult to be cleaned using a conventional suction brush 70 (FIG. 2).

The interior of the accessory 110 defined by the walls, the suction port 135 of the crevice attachment 130 and the widened section 155 of the upholstery attachment 150 are in fluid communication with each other, thereby forming an airflow passage therethrough. When they are attached on the handle tube 60 and suction force is generated, air is drawn into and through the accessory 110, thereby performing the desired cleaning operations.

Figure 4A:
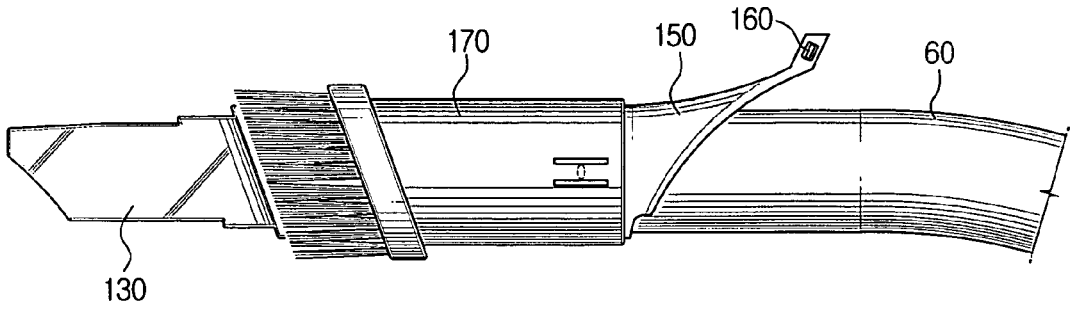
Figure 4B:
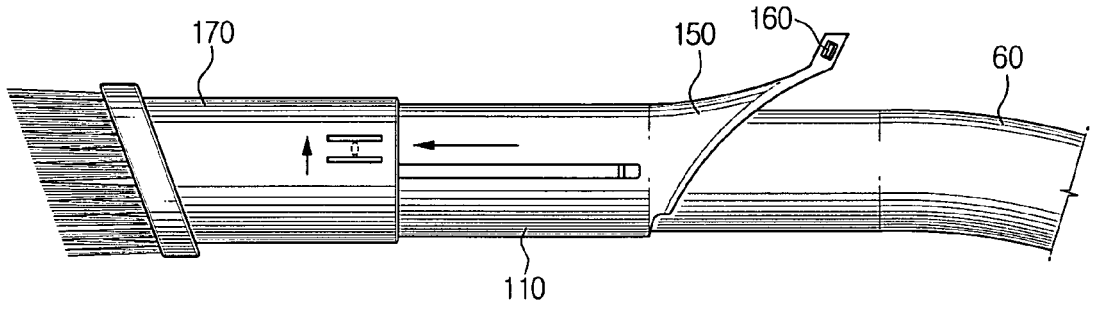
Figure 4C:
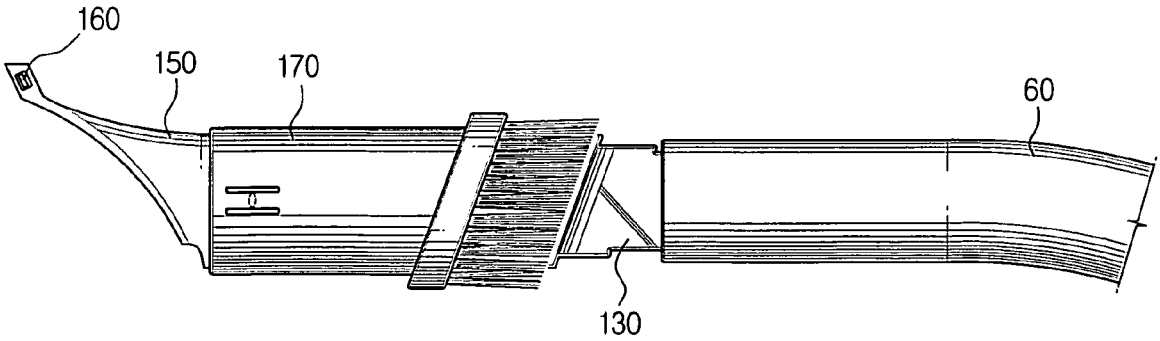

Hereinafter, operation of the accessory assembly 100 according to the present invention will be described with reference to FIGS. 4A, 4B and 4C. FIGS. 4A, 4B and 4C are side views, each showing a separate operation of the accessory assembly according to the present invention, in which FIG. 4A illustrates the operation of the crevice attachment 130, FIG. 4B illustrates the operation of the dusting attachment 170 and FIG. 4C illustrates the operation of the upholstery attachment 150.

At first, if electric power is applied to the vacuum cleaner, suction force is generated in the vacuum cleaner body and air containing dust and dirt from a surface to be cleaned is drawn in through the suction brush 70. The drawn in air is directed to the vacuum body 50 through the extension tube 65, the handle tube 60 and the flexible hose 55 (see FIG. 2).

If the surface to be cleaned comprises a groove, a narrow gap or a recessed point, the user will separate the extension tube 65 from the handle tube 60, detach the accessory assembly 100 from the tension rib 77 of the connection pipe 75 and assemble the accessory assembly 100 to the handle tube 60.

If the user wishes to clean a narrow corner or gap, it is possible to perform the cleaning using the crevice attachment 130 of the accessory assembly 100, as shown in FIG. 4A. In addition, if dust is drawn in from a corner or a gap with difficulty, or if it is required to perform the cleaning using the brush bristles 173, the user pulls the dusting attachment 170 toward the crevice attachment 130 along the longitudinal rail slot 115.

Then, the user rotates the dusting attachment 170 to a predetermined angle along the circumferential rail 125, fixes it within the second locking projection 127 and then uses the dusting attachment 170, as shown in FIG. 4B. Therefore, the user will be capable of selectively using the dusting attachment during the cleaning of a groove or corner when using the crevice attachment 130 without interrupting the cleaning process in order to reassemble the dusting attachment 170 to the handle tube 60.

In addition, if the user wishes to clean woven materials, such as a sofa, bed or curtain, the user detaches the accessory assembly 100 from the handle tube 60 and reattaches the accessory assembly 100 to the handle tube 60 by insertion of the crevice attachment 130 into the end of handle tube 60, as shown in FIG. 4C. Then, it is possible to easily clean the curtain or the like using the upholstery attachment 150 of the accessory assembly 100.

Therefore, the user will be capable of easily and conveniently using the dusting, upholstery or crevice attachments as needed.

As described above, the inventive accessory assembly for a vacuum cleaner is integrally formed, thereby being compactly configured and occupying a small space. It allows convenient cleaning selectively using the dusting attachment for cleaning of a narrow groove or gap. Moreover, the accessory assembly is convenient in storage and during use.

Furthermore, because the crevice attachment and the upholstery attachment of the accessory assembly are integrally formed, the unit costs of production and processes can be reduced, thereby providing an economic advantage.

While the embodiments of the present invention have been shown and described with reference to the preferred embodiments thereof in order to illustrate the principles of the present invention, the present invention is not limited to the illustrated and described embodiments. It will be understood that various modifications and changes can be made by those skilled in the art without departing from the spirit and scope of the invention as defined by the appended claims. Therefore, it shall be considered that such modifications, changes and equivalents thereof are all included within the scope of the present invention, as defined by the following claims.

What is claimed is:

1. An accessory assembly for a vacuum cleaner comprising:

an accessory body having an outer surface;

a crevice attachment and an upholstery attachment both formed integrally with the accessory body; and a dusting attachment, mounted around the outer surface of the accessory body and being slidably attached thereto and movably disposed on the accessory body.

2. The accessory assembly according to claim 1, wherein the accessory body, the crevice attachment and the upholstery attachment are integrally formed and are in fluid communication with each other.

3. The accessory assembly according to claim 1, wherein the crevice attachment and the upholstery attachment are integrally formed at opposite ends of the accessory body.

4. The accessory assembly according to claim 1, wherein the accessory body has a diameter, the crevice attachment has a suction port smaller than the diameter of the accessory body, the upholstery attachment has a widened section larger than the diameter of the accessory body, and the dusting attachment further comprises brush bristles having ends.

5. The accessory assembly according to claim 4, wherein the accessory body is formed with a longitudinal rail slot for slidably mounting and for guiding the dusting attachment, and one side of an inner surface of the dusting attachment is formed with a rail projection having a size, configuration and orientation corresponding to the longitudinal rail slot.

6. The accessory assembly according to claim 5, wherein one end of the longitudinal rail slot is formed with a first locking projection for retaining the rail projection, the other end of the longitudinal rail slot is formed with a circumferential rail slot to accommodate retention of the dusting attachment when it is turned to a predetermined angle and fixed, and a second locking projection is formed in the circumferential rail.

7. The accessory assembly according to claim 6, wherein the brush bristles extend beyond the suction port of the crevice attachment when the dusting attachment is engaged to the second locking projection.

8. The accessory assembly according to claim 4, wherein the widened section of the upholstery attachment is provided with a floor brush that contacts a surface to be cleaned.

9. The accessory assembly according to claim 4, wherein the suction port of the crevice attachment has an inclined opening relative to the longitudinal direction of the accessory body, and the brush bristles are inclined in the same orientation as the opening of the suction port of the crevice attachment.

10. The accessory assembly according to claim 9, wherein the widened section of the upholstery attachment is formed to be symmetrically but oppositely inclined relative to the incline orientation of the suction port of the crevice attachment when taken with reference to the longitudinal direction of the accessory body.

* * * * *